United States Patent [19]

Grantmyre et al.

[11] 4,295,411

[45] Oct. 20, 1981

[54] IMPACTOR

[75] Inventors: Innes Grantmyre; Brent Miedema, both of Cambridge, Canada

[73] Assignee: Joy Manufacturing Company, Pittsburgh, Pa.

[21] Appl. No.: 81,519

[22] Filed: Oct. 3, 1979

[51] Int. Cl.[3] ..... F01L 17/00; F01L 25/04; F01B 7/18

[52] U.S. Cl. ..... 91/165; 91/276; 91/317; 91/318; 91/321; 92/134

[58] Field of Search ..... 91/165, 276, 318, 321, 91/317; 92/134

[56] References Cited

U.S. PATENT DOCUMENTS

| | | | |
|---|---|---|---|
| 526,342 | 9/1894 | Carlinet | 91/217 |
| 919,035 | 4/1909 | Lane | 91/217 |
| 1,007,295 | 10/1911 | Lane | 91/276 |
| 1,044,263 | 11/1912 | Schumacher | 91/317 |
| 1,205,485 | 11/1916 | Schumacher | 91/317 |
| 3,060,894 | 10/1967 | Dean, Jr. et al. | 91/219 |
| 3,456,744 | 7/1969 | Altschuler | 91/217 |
| 3,739,863 | 6/1973 | Wohlwend | 92/134 |
| 4,062,268 | 12/1977 | Hibbard | 92/134 |
| 4,150,603 | 4/1919 | Etherington et al. | 91/321 |

*Primary Examiner*—Paul E. Maslousky
*Attorney, Agent, or Firm*—J. Stewart Brams

[57] ABSTRACT

An impactor apparatus including novel means for actuation of a motive fluid flow control valve or comparable motive fluid control means.

14 Claims, 5 Drawing Figures

IMPACTOR

BACKGROUND OF THE INVENTION

Figure 1:
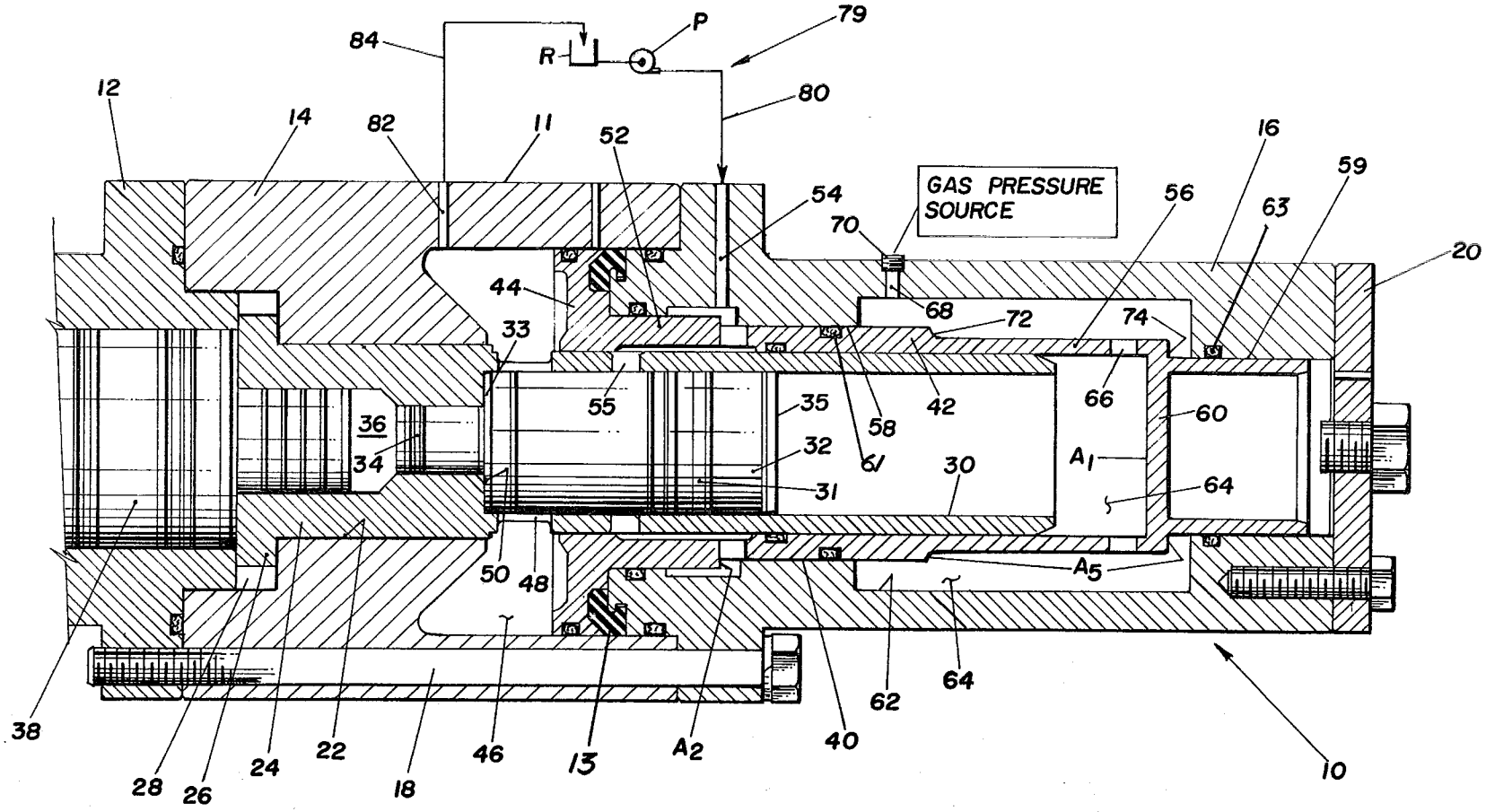

In the art of fluid operable hammers or impactors it is known to provide a spring bias means against which a hammer piston may be "cocked" or upstroked for a subsequent power stroke under the impetus of the spring bias means. For example, U.S. Pat. No. 4,062,268 describes an impactor in which the spring is a gas accumulator which continuously applies a gas pressure bias to one end of a reciprocably carried hammer pistion or hammer and a hydraulic fluid pressure means alternately applies fluid pressure to the opposite end of the hammer piston to upstroke the hammer piston against the continuously applied gas pressure. After each upstroke the hydraulic fluid pressure is vented and the hammer piston is driven by the gas pressure bias through a downstroke or power stroke to deliver an impact blow to a striking bar. U.S. Pat. No. 4,150,603 describes another gas spring type impactor wherein the main motive fluid inlet and exhaust valve is actuated by a reciprocable hammer piston which mechanically contacts a pilot valve during its upstroke. The pilot valve directs actuating fluid pressure to an actuating valve which, in turn, cycles the main motive fluid valve to alternately supply and vent motive fluid flow to the hammer for reciprocation thereof.

Each of U.S. Pat. Nos. 562,342; 919,035; 1,007,295; 1,044,263; 1,205,485; 3,060,894 and 3,456,744 discloses an impactor incorporating a cylindrical sleeve valve which coaxially encompasses a reciprocable hammer piston to form the cylinder bore in which the hammer piston reciprocates. In many of these patents the described impactors are not of the spring bias type in that hammer piston reciprocation involves cycling of the sleeve valve to selected operating positions thereof for directing motive fluid flow alternately to opposite ends of the hammer piston to effect its repetitive upstrokes and power strokes, and the hammer piston, in turn, functions as a valving element to valve motive fluid flow to opposite ends of the sleeve valve for cycling the sleeve valve to its operating positions.

Some prior impactors have been subject to certain deficiencies, the alleviation of which has eluded practitioners of the art heretofore. For example, in many of those impactors in which a main motive fluid valve alternately admits and exhausts motive fluid flow to opposite ends of a reciprocably carried hammer, reliable cycling of the main valve often has been achieved only through reliance on inherent apparatus operating characteristics or motive fluid properties such as hammer mass, mechanical friction forces (e.g. seal friction), or judiciously selected motive fluid operating temperature and viscosity. Furthermore, it is believed such problems often have been aggravated in spring bias type impactors, and particularly in gas spring type impactors in that prior efforts to simplify motive fluid valving in such impactors often have required even greater reliance upon inherent properties of the apparatus and the motive fluid for successful operation.

SUMMARY OF THE INVENTION

The present invention contemplates various improvements over heretofore known impactor actuating systems including but not limited to a simplified and reliable main motive fluid valve actuating scheme which permits positive pressure actuation of the main motive fluid valve through cooperation of the motive fluid flow supply system with a gas spring type hammer piston drive system which is slave to the motive fluid flow supply system. One embodiment of the invention incorporates a main motive fluid valve formed as a cylindrical sleeve encompassing the hammer and forming at least a portion of the cylinder in which the hammer reciprocates. In another embodiment of the invention a stationary, open-ended cylinder is interposed radially between the hammer and an encompassing sleeve valve such that no sliding contact occurs between the sleeve valve and the hammer.

Figure 4:
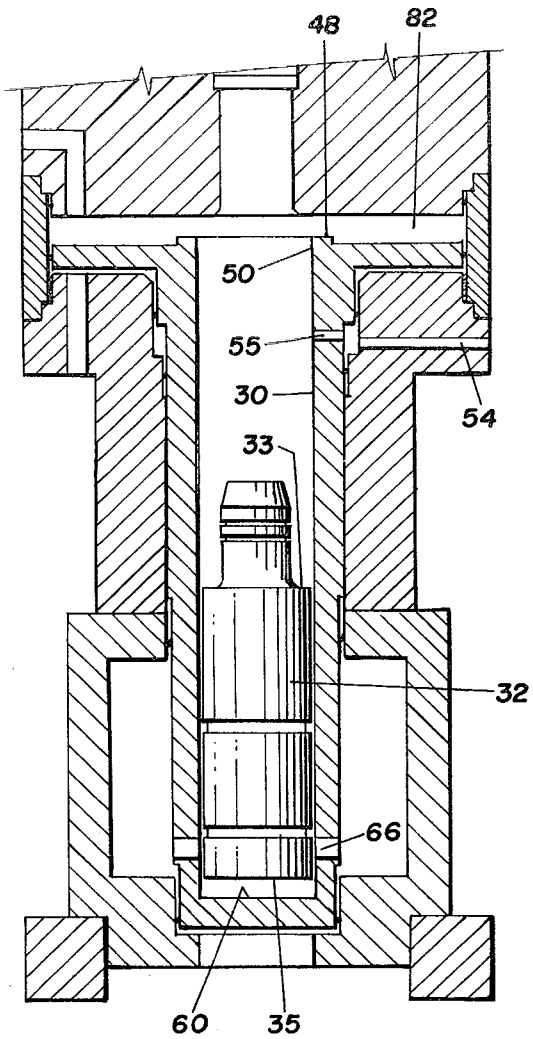
Figure 3:
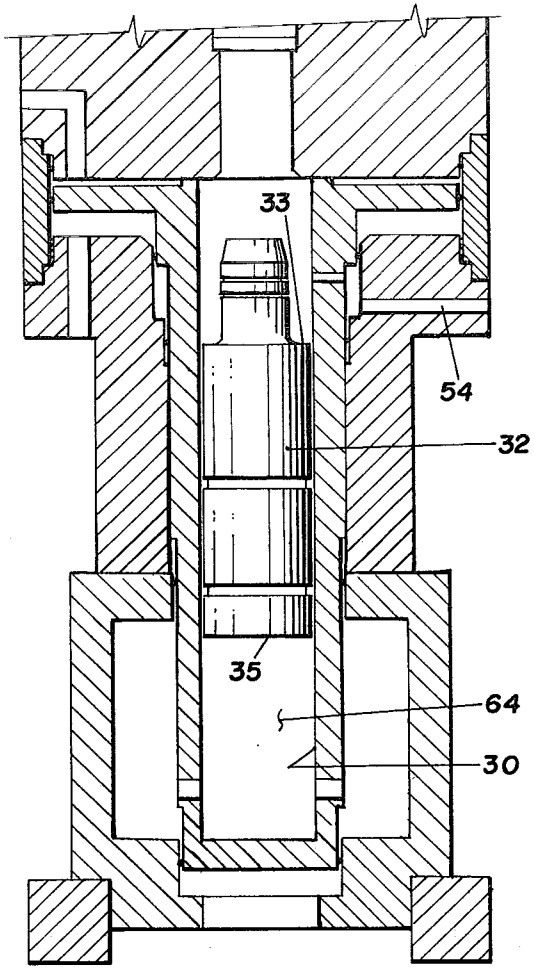
Figure 2:
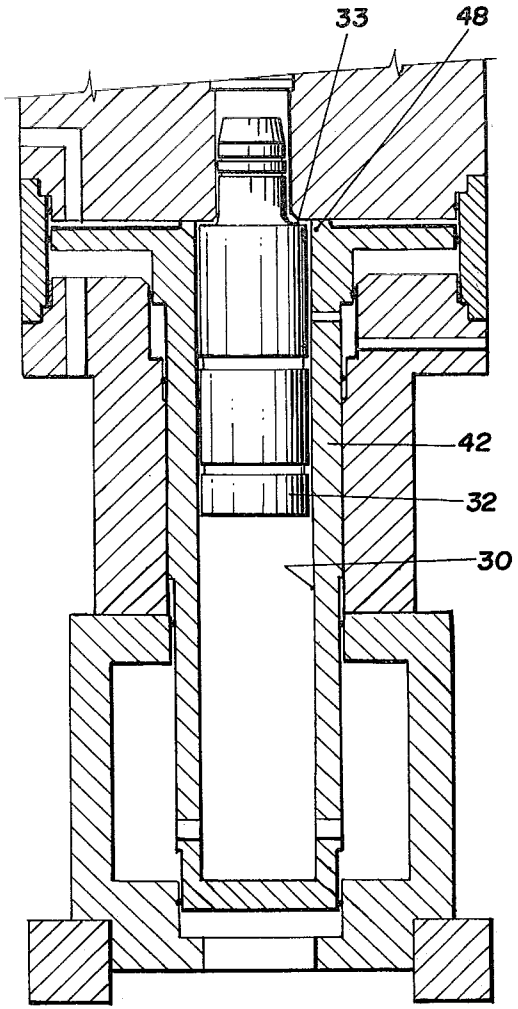
Figure 5:
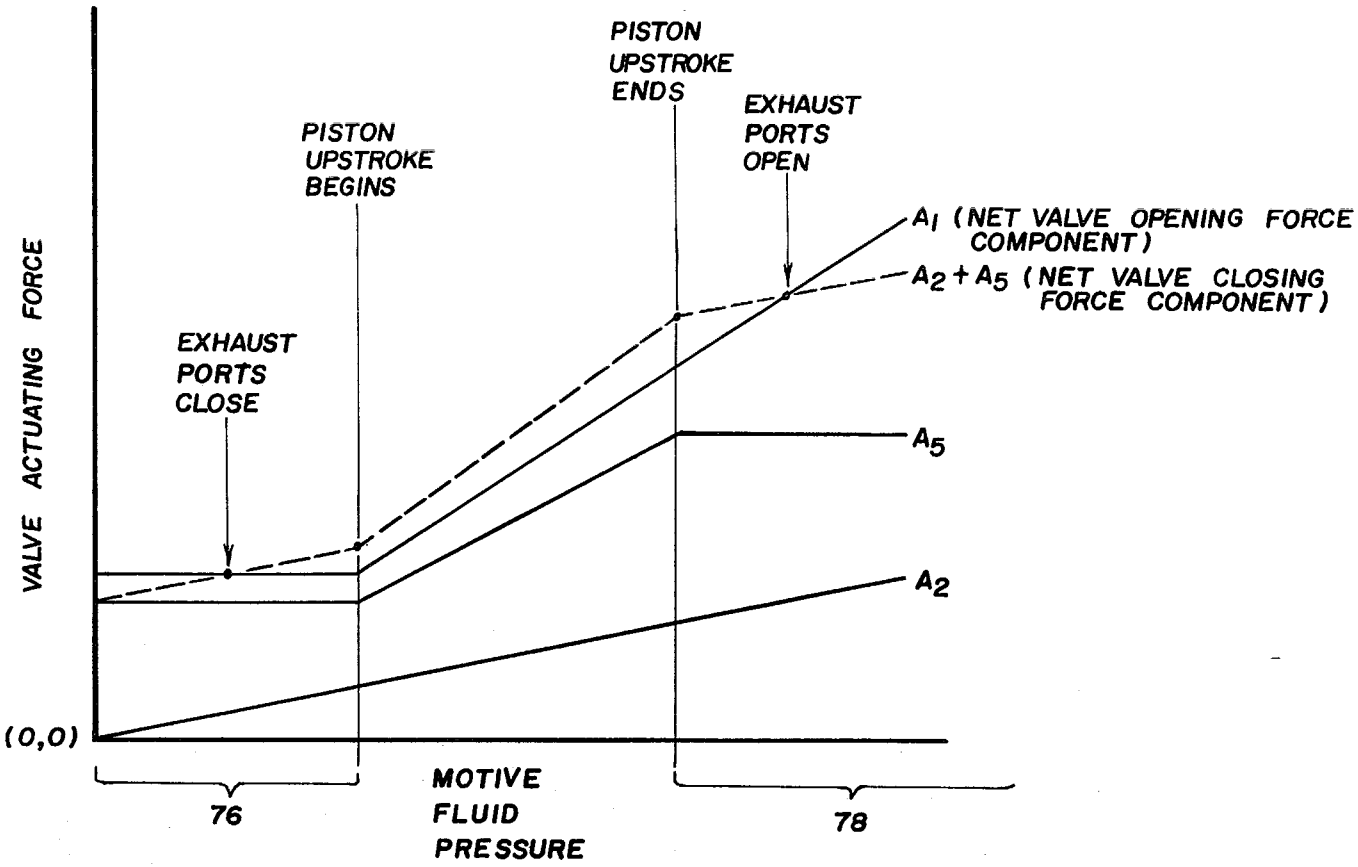

These and other embodiments, objects and advantages of the invention are more fully described in the following specification with reference to the accompanying figures, in which:

FIG. 1 is a fragment of a central longitudinal section of an impactor assembly of the present invention;

FIGS. 2, 3, and 4 are schematic cross-sections similar to FIG. 1 and showing a modified embodiment of the impactor in various stages of its operating cycle; and FIG. 5 is a diagram illustrating the force components acting on the various main valve actuation surfaces as a function of motive fluid pressure.

There is generally indicated at 10 in FIG. 1 an impactor apparatus constructed according to one embodiment of instant invention and including a body 11 comprised of generally annular and coaxially aligned front, intermediate and rear casing members 12, 14 and 16, respectively, which are clamped together by a plurality of side rods 18 to form body 11 of the impactor apparatus. A backhead member 20 is secured to the rearward or righthand end of rear casing member 16 as viewed in FIG. 1 to close the rearward end of body 11, and a front head member (not shown) is similarly secured to the forward end of front casing member 12.

Impactor body 11 has defined therewithin an axially extending, generally stepped bore 22 within which an elongated cylinder member 24 is captively and fixedly retained with respect to body 11 by means of a forward annular flange portion 26 thereof which is captively secured within an enlarged annular space 28 defined at the juncture of front and intermediate casing members 12, 14. Cylinder 24 has defined therewithin a through bore 30 within which a stepped cylindrical hammer piston 32 is reciprocably carried for sliding motion therewithin.

Piston 32 includes body portion 31 having a forward annular face 33 and a rearward face 35. A coaxial nose portion 34 of hammer 32 projects forwardly of annulus 33 and is adapted to be received into an impact chamber 36 defined within cylinder 24 forwardly of bore 30, and a rearward projection of a striking bar 38 carried by front casing member 12 is also disposed within impact chamber 36 for the purpose of receiving impact blows from nose 34 of hammer 32 in the known manner as disclosed in the above cited U.S. Pat. No. 4,062,268, for example.

Cylinder 24 extends coaxially rearwardly within intermediate and rear casing members 14, 16, and in conjunction therewith defines a generally annular space 40 which accomodates an elongated, generally annular sleeve valve member 42 therewithin for axial sliding motion with respect to the radially adjacent casing and cylinder members.

Sleeve valve 42 includes mutually contiguous forward, intermediate and rearward portions as follows. A forward, radially outwardly projecting flange portion 44 of sleeve valve 42 cooperates with cylinder 24 and intermediate casing member 14 to define a generally annular motive fluid receiving chamber 46 (hereinafter the exhaust chamber) which communicates by way of plural, circumferentially distributed motive fluid exhaust ports 48 which penetrate cylinder 24, with a forward end portion 50 of cylinder bore 30 forwardly of hammer 32. Axial sliding motion of sleeve valve 42 selectively covers and uncovers exhaust ports 48 to control fluid flow therethrough. An intermediate portion 52 of sleeve valve 42 is supported for sliding motion within casing member 16 to provide, in conjunction with radially adjacent portions of rear casing member 16 and cylinder 24, a motive fluid flow inlet passage means 54 for delivery of motive fluid flow from a flow source remote from the impactor into cylinder bore forward end portion 50 via plural inlet ports 55. Intermediate sleeve valve portion 52 also includes a piston means identified as area $A_2$ upon which the pressure of motive fluid flow in inlet passage 54 exerts a forward or closing bias upon sleeve valve 42. A rearward portion 56 of sleeve valve 42 is slideably disposed within rear casing member 16 and a pair of axially spaced apart peripheral portions 58, 59 of rear casing member 16 include annular seals 61, 63, respectively, which engage exterior peripheral portions of sleeve valve rear portion 56 for purposes to be described. A transverse wall 60 extends within the interior of sleeve valve rear portion 56 rearwardly of cylinder member 24 to effectively provide a rear closure for cylinder bore 30.

An interior, annular undercut 62 is formed in rear casing member 16 intermediate seals 61, 63 radially outwardly of sleeve valve rear portion 56. Undercut 62 communicates continuously with cylinder bore 30 rearwardly of hammer 32 through plural ports 66 which radially penetrate sleeve valve portion 56 axially intermediate transverse wall 60 and the rearward end of cylinder 24.

It will be appreciated that the described impactor is generally of the gas spring type wherein a closed gas pressure drive system or gas pressure accumulator 64 is defined within the space bounded by the annular seals 61, 63 adjacent opposite ends of undercut 62, the portion of cylinder bore 30 to the rear of hammer 32, and the respective contiguous portions of the interior space defined within sleeve valve rear portion 56 forwardly of transverse wall 60. This gas pressure accumulator space 64 is provided with a charging port 68 for connection thereto of a suitable gas pressure source as indicated, whereby accumulator 64 may be precharged to a pressure of, for example, 1000 to 1200 psi. Charging port 68 includes any suitable valve means 70 for closing port 68 upon completion of precharging, and perferably the gas pressure source is then removed. It will be further apparent that the gas spring thus created is a captive or slave to the motive fluid supply system in that any accumulator pressure charge above its precharge pressure is a function of hammer piston position, which in turn is a function of the supplying and venting of motive fluid to and from the front of hammer piston 32.

The gas spring is operative not only to bias hammer 32 forwardly but in addition is operative to apply actuating force components to sleeve valve 42 as follows. The pressure of the gas contained within accumulator space 64 exerts a continuous forward or valve closing bias on a pair of annular areas 72, 74 formed on the exterior periphery of sleeve valve 42 within the longitudinal extent of undercut 62 and which together define a piston of area designated hereinafter as $A_5$. The accumulator gas pressure also exerts a continuous rearward or valve opening bias on the forwardly facing surface of transverse wall 60 whose area is designated hereinafter as $A_1$.

FIG. 5 illustrates the force components which act on the several sleeve valve actuating pistons or surface areas $A_1$, $A_2$ and $A_5$ during the impactor cycle. Generally, each such actuating force component is proportional to the pressure applied to the respective surface area. Thus the force component acting on area $A_2$ is directly proportional to motive fluid inlet pressure as depicted by line $A_2$ in FIG. 5. The force components acting on area $A_5$ and $A_1$ are similarly proportional to the accumulator gas pressure during the hammer piston upstroke, and may be constant for certain ranges of inlet fluid pressure valves as will be explained hereinbelow. It is further noted that at any inlet fluid pressure the sum of the force components $A_2$ and $A_5$ is the net sleeve valve closing force component and is represented in FIG. 5 by dashed line $A_2+A_5$.

For each force component line in FIG. 5 the proportional relationship of the actuating force components to inlet fluid pressure during the hammer upstroke is represented by a line segment passing through the origin (0,0) and having a slope which is larger for the larger areas. Thus it will be seen that: (1) Area $A_2$ preferably is smaller than area $A_5$ which in turn, is smaller than area $A_1$; (2) The actuating force component on area $A_5$ is substantially constant throughout an initial motive fluid pressure range 76, and throughout a terminal motive fluid pressure range 78 (i.e., before and after the piston upstroke) and increases in proportion to motive fluid inlet pressure throughout the intervening motive fluid pressure range and the actuating force component on area $A_1$ is substantially constant throughout pressure range 76 and increases thereafter in proportion to increasing motive fluid pressure. If areas $A_1$ and $A_5$ are not equal, as in the present case, movement of sleeve valve 42 will produce some small but inconsequential variations in the $A_1$ and $A_5$ force components in pressure ranges 76, 78. Thus, the description herein relates to constant force components on $A_1$ and $A_5$ in pressure ranges 76, 78, it being understood that small force component variations due to sleeve valve cycling movement will not alter sleeve valve cycling so long as the overall scheme of valve operating force components is maintained. (3) The sum of the valve closing force components, indicated by dashed line $A_2+A_5$ increases with increasing inlet fluid pressure in the same proportion as the increase for area $A_2$ alone through initial and terminal motive fluid pressure ranges 76, 78 in which force component $A_5$ is constant. That is, in pressure ranges 76 and 78 the slope of line $A_2+A_5$ is the same as that of line $A_2$. Throughout the intervening motive fluid pressure range the rate of increase of force component $A_2+A_5$ is greater than in pressure ranges 76, 78 and is at least as great as that of force component $A_1$. These variations in the rate of increase of force component $A_2+A_5$ with increasing pressure are the result of hammer piston upstroke motion as will be explained hereinbelow. Each such change of rate produces a break or knee in line $A_2+A_5$ as shown. Dashed line $A_2+A_5$ thus represents the net sleeve valve closing force component as a function of motive fluid inlet pressure whereas line $A_1$ represents the net sleeve valve opening force component for the same values of motive fluid inlet pressure. Thus, actuation of sleeve valve 42 occurs at those motive fluid pressures where the relative magnitudes of the valve opening and closing force components are reversed, i.e. at the intersections of line $A_1$ with line $A_2+A_5$.

The necessity of providing area $A_5$ will be seen in the dilemma which would be posed if the disclosed impactor lacked area $A_5$. Because accumulator 64 is slave to the motive fluid supply system, there exists for steady state hammer piston upstroking, a fixed proportional relationship between inlet fluid pressure and accumulator gas pressure throughout the hammer upstroke. Thus, there is also a fixed proportional relationship between the respective force components acting on areas $A_1$ and $A_2$. Under such conditions it would not be possible to alter the relative magnitudes of force components $A_1$ and $A_2$ and one would thus be greater than the other for all values of motive fluid pressure (i.e., lines $A_1$ and $A_2$ would be non-intersecting lines diverging from origin, 0,0, in FIG. 5). Positive pressure actuation of the sleeve valve therefore would not be possible. The force component attributable to area $A_5$ obviates this dilemma as will become clear from the following description of the impactor operating cycle. The operating cycle is described with reference to FIGS. 1–4 which show the impactor at various stages of its cycle. It is noted that FIG. 1 shows the hereinabove described embodiment of the invention whereas FIGS. 2–4 show an alternate embodiment wherein hammer piston 32 is slideably disposed directly within sleeve valve 42. That is, the interior periphery of sleeve valve 42 forms the cylinder bore 30 within which hammer 32 reciprocates. Insofar as the below-described operation of sleeve valve 42 is concerned, the two embodiments of the impactor are equivalent.

A motive fluid supply means 79 is shown schematically in FIG. 1 as a reservoir R from which motive fluid is delivered by a suitable pump P (e.g. a constant flow pump) through a pressure fluid conduit 80 to motive fluid inlet passage means 54. The flow of motive fluid is utilized to upstroke hammer 32 against the gas pressure bias of accumulator 64 and is then vented to reservoir R by way of an exhaust system 82 which includes the exhaust chamber 46 and a suitable exhaust conduit 84, whereupon hammer 32 is driven through its power stroke by the accumulator gas pressure bias.

Initially in the cycle hammer 32 is in its extreme downstroke position as shown in FIG. 1, having just completed a power stroke. Prior to impact the motive fluid pressure in inlet 54 is effectively nil, or more precisely is approximately equal to the back pressure in exhaust system 82 as fluid inlet ports 55 communicate openly through cylinder bore 30 with the open exhaust ports 48 throughout a major part of the hammer power stroke as shown in FIG. 4.

During the latter part of the hammer powder stroke the forward end of hammer body 31 covers inlet ports 55 to effectively isolate inlet 54 from exhaust system 82, and motive fluid pressure in inlet 54 thus begins to increase. Although there is a predetermined, controlled leakage of motive fluid over the periphery of body 31 from inlet ports 55 to the forward end 50 of bore 30, this controlled leakage nevertheless is sufficiently restricted to permit fluid pressure in inlet 54 to increase. Accordingly, the valve actuating force component on area $A_2$ increases along line $A_2$ of FIG. 5, whereas the force components represented by lines $A_1$ and $A_5$ in FIG. 5 remain constant as they are proportional to accumulator pressure which is the precharge pressure when hammer 32 is in its extreme downstroke position.

As inlet fluid pressure continues to increase, the net sleeve valve closing force component $A_2+A_5$ also increases until it exceeds valve opening force component $A_1$, at which point in the cycle sleeve valve 42 is shifted forward to close exhaust ports 48 (FIG. 2). The controlled motive fluid leakage over the periphery of hammer body 31 to the forward end portion 50 of bore 30 now finds no escape through exhaust ports 48 and thus begins to pressurize the cylinder bore portion 50. Fluid pressure upon forward piston face 33 thus increases until the net force thereof exceeds the accumulator precharge bias on rear piston face 35 and piston 32 begins its upstroke (FIG. 3). Throughout its upstroke piston 32 is reducing the volume of gas accumulator space 64 and proportionally increasing the gas pressure therein. Motive fluid pressure in inlet 54 also increases as it is just sufficient throughout the steady state upstroke to overcome the gas pressure bias of accumulator 64 (i.e. the piston does not accelerate through its upstroke). Accordingly, throughout the piston upstroke the force components on area $A_1$, $A_2$ and $A_5$ increase proportionally with inlet fluid pressure whereby the net valve closing force component $A_2+A_5$ remains greater than the net valve opening force component $A_1$ to maintain exhaust ports 48 closed throughout the upstroke.

Hammer 32 ultimately reaches its full upstroke position (FIG. 4) in which it either contacts transverse wall 60 as in the embodiment of FIG. 1, or it closes accumulator ports 66 to create a gas cushion between rear piston face 35 and transverse wall 60 as in the embodiment of FIGS. 2 through 4. In either case, at this point in the impactor cycle further upstroke movement of hammer 32 will not further pressurize the gas contained in accumulator undercut 62. Accordingly, force component $A_5$ will remain constant for further inlet fluid pressure increases. This event, which marks the effective termination of the piston upstroke, is indicated by the upper break or knee in line $A_2+A_5$ which represents a reduction in the rate of increase of force component $A_2+A_5$.

As inlet fluid pressure increases further, valve opening force component $A_1$ ultimately will exceed force component $A_2+A_5$ as indicated at the upper intersection of the respective force lines in FIG. 5, whereupon sleeve valve 42 will begin to open or uncover exhaust ports 48. Motive fluid in inlet 54 and in cylinder bore portion 50 is thus vented to exhaust chamber 46 and the fluid pressure in inlet 54 falls to exhaust system back pressure thus further increasing the magnitude of opening force component $A_1$ over closing force component $A_2+A_5$. That is, the $A_2$ portion of force $A_2+A_5$, being a function of inlet fluid pressure, becomes substantially nil whereas force components $A_1$ and $A_5$, being functions of hammer piston position in its stroke, remain at the elevated values achieved by movement of hammer 32 to its upstroke position. Sleeve valve 42 thus opens rapidly to the full open position thereof against a resilient bumper 13 as shown in FIG. 1 to fully uncover exhaust ports 48, and the unrestrained gas accumulator bias on rear piston face 35 forcibly drives hammer 32 through its downstroke to complete the impactor cycle.

It is noted that for the described impactor the sum of area $A_2$ and $A_5$ must be greater than area $A_1$ to ensure that sleeve valve 42 will remain closed during the piston upstroke. The requirement is conditioned upon the opposite end surface areas of piston 32 being equal. A more general condition for other piston face area relationships is that the magnitude of the force component acting on area $A_2$ plus the force component acting on area $A_5$ be greater than the magnitude of the force component acting on area $A_1$ throughout the piston upstroke. In addition, it is preferred, although not essential, that area $A_5$ be less than area $A_1$ to ensure that exhaust ports 48 will remain open throughout the piston downstroke. This latter area relationship is not critical as it is believed that once exhaust ports 48 have been opened to initiate a downstroke, fluid pressure within exhaust chamber 46 will act on the forward face of sleeve valve flange 44 to help maintain valve 42 open. In other words, the valve opening force component attributable to fluid pressure on valve flange 44 has not been taken into account in the above analysis and cycle description inasmuch as it is not essential to include the flange portion 44 on valve 82. The described embodiments of the invention do not require this force component for successful operation although it is recognized that some benefit in terms of greater possible variation in the area relationships of areas $A_1$ and $A_5$ may be feasible in light thereof.

According to the description hereinabove the present invention provides novel improvements in impactor apparatus which permit greatly simplified motive fluid valve cycling for particular types of spring bias impactors, as described. The invention permits such simplified valve operation even in those impactors having a motive fluid flow control system including but a single motive fluid inlet and outlet, and wherein the "spring" or other comparable hammer drive system in a captive or slave to the motive fluid flow control system. The invention also reduces recoil during the piston power stroke.

Although the invention has been described with particular reference to certain preferred embodiments thereof, the inventors have contemplated alternative embodiments with various modifications. These and their equivalent structures having been envisioned and anticipated by the inventors, it is intended that the invention be construed as broadly as permitted by the scope of the claims appended hereto.

What is claimed is:

1. In an impactor assembly in which a hammer piston is reciprocably movable through alternate work strokes and return strokes within an elongated bore with the work strokes being effected by a closed drive system which continuously urges said hammer piston in one axial direction toward a rest position thereof by applying to said hammer piston a variable driving impetus of a magnitude dependent upon the displacement of said hammer piston from said rest position and the return strokes being effected by the selective supplying of hydraulic fluid flow from a fluid flow supply means into said bore to apply to said hammer piston a return impetus which displaces said hammer piston from said rest position by overcoming said variable driving impetus, and wherein a valve means includes a valve member which is selectively movable to a supply position to permit the supplying of hydraulic fluid flow into said bore to effect such a return stroke and subsequently is movable to an exhaust position to permit expulsion of hydraulic fluid from said bore thereby permitting said drive system to effect such a work stroke, the improvement comprising:

actuator means integral with said valve means and including surface means upon which said drive system and said hydraulic fluid flow from said fluid flow supply means continuously exert a bias to cycle said valve member between said supply and exhaust positions by providing variable valve actuating impetus to act on said valve member wherein said valve actuating impetus includes a first component resulting from the bias of said drive system on said surface means to urge said valve member toward said supply position, a second component resulting from the bias of said hydraulic fluid flow on said surface means to urge said valve member toward said supply position and a third component resulting from the bias of said drive system on said surface means to urge said valve member toward said exhaust position.

2. The improvement as claimed in claim 1 wherein said valve member includes an elongated sleeve valve means encompassing said hammer piston and movable axially thereof to said supply and exhaust positions.

3. The improvement as claimed in claim 2 wherein said drive system includes a gas pressure accumulator which continuously applies a gas pressure bias to said hammer piston to provide said variable driving force.

4. The improvement as claimed in claim 1 wherein each of said plural valve actuating force components is proportional to said variable driving force substantially throughout each return stroke of said hammer piston.

5. The improvement as claimed in claim 4 wherein said first component is continuously proportional to said variable driving force.

6. The improvement as claimed in claim 5 wherein said second component is proportional to said variable driving force throughout each such return stroke.

7. The improvement as claimed in claim 6 wherein said third component is proportional to said variable driving force throughout each such return stroke.

8. The improvement as claimed in claim 7 wherein the magnitude of said variable driving force is proportional to the displacement of said hammer piston from said rest position.

9. An impactor assembly comprising:

a body having defined therewithin an elongated bore;

a hammer piston axially slidable within said bore;

a closed fluid pressure drive system operable to continuously bias said hammer piston in one axial direction within said bore;

a fluid flow path formed within said body for directing a flow of hydraulic fluid from a fluid flow supply means to said hammer piston for biasing said hammer piston in the opposite axial direction opposite said one axial direction;

a valve means for selectively controlling said flow of hydraulic fluid within said fluid flow path to intermittently bias said hammer piston in said opposite axial direction thereby effecting alternate strokes of said hammer piston in said one and said opposite axial directions within said bore;

said valve means including integral actuator means cooperable with said flow of hydraulic fluid from said fluid flow supply means and with said drive system for continuously applying to said valve means a sufficient impetus to actuate said valve means for said intermittent biasing of said hammer piston in said opposite axial direction; and said actuator means including means continuously cooperable with said drive system to impose a respective pair of oppositely directed impetus components on said valve means with one of said pair of components biasing said valve means in said one axial direction and the other of said pair of components biasing said valve means in said opposite axial direction.

10. An impactor assembly as claimed in claim 9 wherein said valve means includes sleeve valve means encompassing said bore and movable axially thereof to selected operational positions thereof for said selective biasing of said hammer piston.

11. An impactor assembly as claimed in claim 10 wherein said actuator means includes annular surface means encompassing said bore.

12. An impactor assembly as claimed in claim 11 wherein said drive system includes annular chamber means encompassing said bore.

13. An impactor assembly as claimed in claim 12 wherein the bias of said closed fluid pressure system on said hammer piston is of a magnitude dependent upon the axial position of said hammer piston within said bore.

14. An impactor assembly as claimed in claim 13 wherein said one and said other of said force components are of magnitude proportional to the magnitude of said bias of said closed fluid pressure system on said hammer piston substantially throughout the alternate strokes of said hammer piston within said bore.

* * * * *